United States Patent [19]

Hyden

[11] 4,099,457

[45] Jul. 11, 1978

[54] METHOD FOR DISCHARGING REFUSE

[75] Inventor: Hans Olof Hyden, Stockholm, Sweden

[73] Assignee: AB Centralsug, Solna, Sweden

[21] Appl. No.: 737,569

[22] Filed: Nov. 1, 1976

Related U.S. Application Data

[63] Continuation-in-part of Ser. No. 573,331, Apr. 30, 1975, abandoned, which is a continuation of Ser. No. 332,099, Feb. 13, 1973, abandoned.

[30] Foreign Application Priority Data

Feb. 25, 1972 [SE] Sweden ..... 2384/72

[51] Int. Cl.[2] ..... B30B 7/04

[52] U.S. Cl. ..... 100/42; 100/41; 100/215; 100/249; 302/59

[58] Field of Search ..... 100/179, 192, 249, 229 A, 100/42, 35, 232, 41, 215; 302/50, 59, 62; 214/23; 110/8 C, 109

[56] References Cited

U.S. PATENT DOCUMENTS

| | | | |
|---|---|---|---|
| 1,819,480 | 8/1931 | Paxton | 100/179 |
| 2,290,809 | 7/1942 | Morrow | 302/50 |
| 2,780,987 | 2/1957 | Wall | 100/249 |
| 3,434,392 | 3/1969 | Landers | 100/249 |
| 3,583,770 | 6/1971 | Medhammar | 302/59 |
| 3,621,774 | 11/1971 | Dedio | 100/249 |
| 3,654,854 | 4/1972 | Cook | 100/249 |
| 3,828,663 | 8/1974 | Poplinski | 100/249 |

FOREIGN PATENT DOCUMENTS

| | | | |
|---|---|---|---|
| 81,895 | 11/1934 | Sweden | 100/192 |

*Primary Examiner*—Billy J. Wilhite
*Attorney, Agent, or Firm*—Spencer & Kaye

[57] ABSTRACT

A device for discharging refuse through a discharge pipe being in communication with a hopper having an outlet through which refuse is successively introduced into the discharge pipe from a vacuum transport system performs the following operations:

A compactor gate is advanced into the discharge pipe in a direction perpendicular to the length dimension of the discharge pipe at a location between the hopper outlet and a discharge outlet to block the internal longitudinal passage thereof to substantially prevent air from being drawn into the vacuum transport system through discharge outlet and the hopper. Thereafter, a compactor pusher is repeatedly reciprocated in the discharge pipe from a withdrawn limit position in which communication between the hopper outlet and the discharge pipe is open, towards the lowered compactor gate to accumulate and compress successively introduced refuse between the compactor pusher and the compactor gate. While the compactor pusher is reciprocating, the compactor gate is withdrawn to clear the discharge pipe passage when the refuse compressed between the compactor pusher and the compactor gate has reached a sufficient density to form a substantially vacuum tight plug. During continued reciprocation of the compactor pusher and in timed coordination therewith, an edge of the compactor gate firmly clamps a refuse portion against the discharge pipe, while the reciprocating compactor pusher is being withdrawn to the withdrawn limit position, and the compactor gate is withdrawn from the refuse clamping position to clear the discharge pipe passage, while the reciprocating compactor pusher is moving from the withdrawn limit position into the discharge pipe to forward the refuse previously accumulated and compressed towards and through the discharge outlet of the discharge pipe.

3 Claims, 7 Drawing Figures

METHOD FOR DISCHARGING REFUSE

CROSS-REFERENCE TO RELATED APPLICATION

This is a continuation-in-part of application Ser. No. 573,331, filed Apr. 30, 1975, now abandoned, which, in turn, is a continuation of application Ser. No. 332,099, filed Feb. 13, 1973, now abandoned.

BACKGROUND OF THE INVENTION

This invention relates to the field of refuse processing and finds particular application in vacuum transport systems which handle refuse, such as household garbage.

Conventionally, the refuse transported by and separated from the air stream in the system, is periodically discharged therefrom through a discharge pipe and deposited, for example, in containers for final disposition or further conveyance. Conventionally the discharge process is discontinuous and sluice-means are used to avoid open communication between the closed vacuum transport system and the ambient atmosphere. However, it is desirable to perform the refuse discharge operation in a continuous manner while insuring that such refuse discharge operation does not adversely affect the efficiency of the vacuum transport system by allowing air to be drawn in through the open passage, and, accordingly, it is a desideratum to block this passage against substantial inflow of air even while the discharge operation is in progress to thus maintain the transport system substantially vacuum tight.

It has now been recognized that a feasible manner of maintaining the system vacuum tight while the refuse discharge operation is in progress is to provide a blockage by the refuse itself which thus is to function essentially as a vacuum plug as it is extruded through the discharge opening.

It has been found, however, that in devices used heretofore, the density of the refuse in the extrusion phase, has not been sufficient to function satisfactorily as a vacuum plug. The known discharge devices include a reciprocating pusher, which, in its withdrawn position allows refuse material to be introduced into the discharge tube inlet through a hopper connected to the vacuum transport system. Thereafter, the pusher is actuated and thus the refuse material is driven into the discharge tube. Subsequently, the pusher is withdrawn to receive additional refuse material. This stepped feed causes an intermittent discharge of the refuse at the downstream (discharge) and of the discharge pipe.

SUMMARY OF THE INVENTION

It is an object of the invention to provide an improved method for discharging refuse for insuring the formation of a substantially vacuum tight refuse plug during the discharge operation.

This object and others to become apparent as the specification progresses, are accomplished by the invention, according to which, briefly stated, the device for discharging refuse through a discharge pipe being in communication with a hopper having an outlet through which refuse is successively introduced into the discharge pipe from a vacuum transport system, comprises a compactor gate advanced into the discharge pipe in a direction perpendicular to the length dimension of the discharge pipe at a location between the hopper outlet and a discharge outlet of the discharge pipe for blocking the internal longitudinal passage thereof to substantially prevent air from being drawn into the vacuum transport system through the discharge outlet and the hopper. The device further has a compactor pusher which is thereafter repeatedly reciprocated in the discharge pipe from a withdrawn limit position in which communication between the hopper outlet and the discharge pipe is open, towards the lowered compactor gate to accumulate and compress successively introduced refuse between the compactor pusher and the compactor gate. While the compactor pusher is reciprocating, the compactor gate is withdrawn to clear the discharge pipe passage when the refuse compressed between the compactor pusher and the compactor gate has reached a sufficient density to form a substantially vacuum tight plug. During continued reciprocation of the compactor pusher and in timed coordination therewith, the previously withdrawn compactor gate is again advanced into the discharge pipe to firmly clamp a refuse portion against the discharge pipe, while the reciprocating compactor pusher is being withdrawn to the withdrawn limit position, and the compactor gate is withdrawn from the refuse clamping position, while the reciprocating compactor pusher is moving from the withdrawn limit position into the discharge pipe to forward the refuse, continuously accumulated and compressed during previous reciprocation of the compactor pusher, towards and through the discharge outlet.

The above-outlined method ensures that the density of the refuse is increased to such a degree that the refuse forms a substantially vacuum tight plug as the discharge operation is in progress during the refuse compressing and forwarding stroke of the compactor pusher, while the combined action of the partly advanced compactor gate and the clamped and thus additionally condensed refuse portion will resist the increased vacuum action due to the retraction of the compactor pusher and thus not only substantially prevent air from being drawn into the vacuum system but also prevent the most recently accumulated and compressed portions of the refuse from again becoming detached from the previously formed plug.

It will be understood that the process of first forming a refuse plug against the fully advanced compactor gate and then forwarding and discharging (extruding) the plug past the temporarily withdrawn compactor gate will be applied during start-up and an ensueing period of operation of the device whereas an interruption of operation after formation of a refuse plug merely will require holding the compactor pusher stationary in its withdrawn limit position and holding the compactor gate stationary in its refuse clamping position. Operation is resumed by again starting the reciprocation of the compactor pusher and the coordinated advancing and withdrawing movements of the compactor gate.

DESCRIPTION OF THE PREFERRED EMBODIMENT

Figure 1:
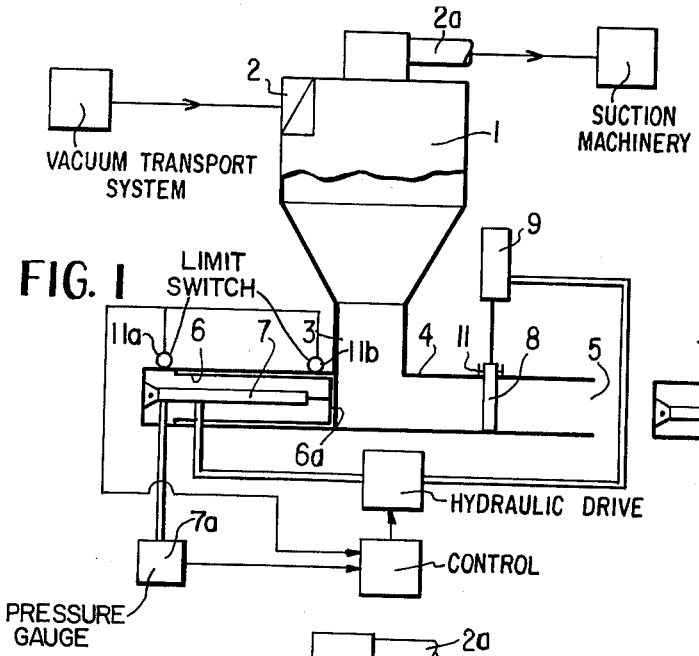
FIG. 1 is a schematic side elevational view of the refuse discharge device designed according to a preferred embodiment of the invention.

Turning now to FIG. 1, there is schematically illustrated the discharge device associated with a conventional vacuum transport system for handling refuse, such as household garbage.

The discharge device includes a hopper 1 having a hopper inlet 2 coupled to a vacuum transport system, a connection 2*a* communicating with a suction machinery and an outlet 3. The substantially vertically oriented hopper outlet 3 merges into a discharge pipe 4 having, at a distance spaced from the hopper outlet 3, a discharge outlet 5.

In the discharge pipe 4 there is arranged a compactor pusher 6 adapted, with its frontal face 6*a*, to incrementally advance refuse admitted to the discharge pipe 4 through the hopper outlet 3, as described later in more detail. The compactor pusher 6 is coupled to a driving device, such as a hydraulic power cylinder 7. Between the hopper outlet 3 and the discharge outlet 5, the discharge pipe 4 has a lateral port structure 11 wherein a compactor gate 8 is arranged for substantially vertical reciprocation in sealing relationship to the discharge pipe wall. For this purpose, the compactor gate 8 is connected to a drive, such as a hydraulic power cylinder 9, by means of which the compactor gate 8 can be advanced into the discharge pipe 4 transversely to its lenth dimension or can be withdrawn therefrom to completely clear the internal passage of the discharge pipe. The discharge pipe 4 may be, for example, of rectangular cross section and may be 4 feet wide and 3 feet high. The outline of the frontal face 6*a* of the compactor pusher 6 expediently corresponds to the cross-sectional outline of the inner passage of the discharge pipe, so as to substantially fill the cross section thereof. Similarly, the compactor gate 8 is so dimensioned that it entirely blocks, in a substantially vacuum tight manner, the passage of the discharge pipe 4 when fully lowered thereinto.

In the description that follows, the operation of the above-described refuse discharge device will be set forth in conjunction with FIGS. 1, 2, 3 and 4.

When the vacuum transport system starts operation, the discharge pipe 4 is substantially still empty. The compactor pusher 6 is in its withdrawn limit position to fully open communication between the hopper outlet 3 and the inside of the discharge pipe 4. The compactor gate 8 is in its fully lowered position in which it entirely fills the cross sectional passage of the discharge pipe 4, and substantially prevents air from being drawn in through the discharge outlet 5 and the hopper 1 into the vacuum transport system. This initial, pre-operational position of the discharge device is illustrated in FIG. 1.

The refuse separated in the hopper 1 from the air stream flowing from inlet 2 to connection 2*a* is fed by gravity into the discharge pipe 4 where, as a result, the refuse accumulates between the lowered compactor gate 8 and the withdrawn compactor pusher 6.

Figure 2:
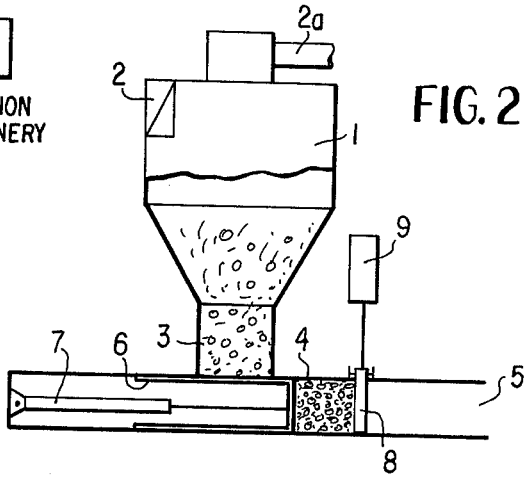
FIGS. 2, 3 and 4 are schematic side elevational views of the same embodiment in successive operational phases thereof.

Subsequently, the still loose refuse accumulated between the compactor pusher 6 and the fully lowered compactor gate 8 is gradually compressed by reciprocating the compactor pusher 6 between its withdrawn limit position illustrated in FIG. 1 and an advanced limit position in the discharge pipe 4 near the lowered compactor gate 8. This compacting process is in progress until between the advancing compactor pusher 6 and the compactor gate 8 the refuse has reached a predetermined density that gives the refuse the required property to constitute a vacuum tight seal in the passage of the discharge pipe 4. The density values may be ascertained, for example, by sensing the resistance encountered by the compactor pusher 6 during its advance. The progress of this compressing phase is depicted in FIG. 2 which illustrates the compactor pusher prior to attaining its advanced limit position.

When the desired density of the refuse is reached, the compactor gate 8 is, by actuating the hydraulic power cylinder 9, entirely lifted out of the passage of the discharge pipe 4. Thus, as the compactor pusher 6 during continued reciprocation moves forward compacting additionally supplied refuse into pipe 4 refuse in compacted state is advanced beyond the compactor gate 8 until the compactor pusher 6 reaches its advanced limit position in the discharge pipe 4 just upstream of the compactor gate 8. It is noted that the distance between the two limit positions (thus, the stroke of the compactor pusher 6) may be about 6–8 feet for a compactor pusher having a frontal face 6*a* of 3 by 4 feet size.

Figure 3:
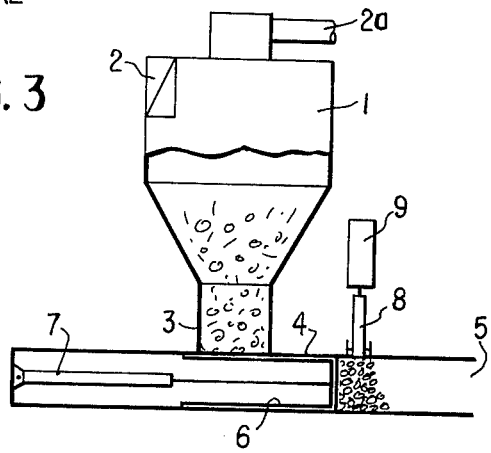
Figure 4:
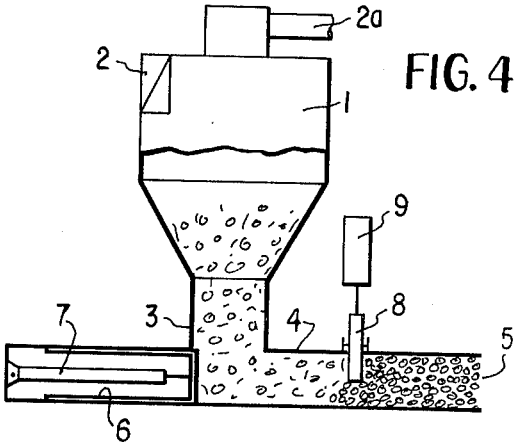

Whenever the reciprocating discharge pusher 6 reaches its forwardmost position shown in FIG. 3, its motion is reversed and it will thus travel back into its withdrawn limit position to allow additional refuse to fall into the now empty space of the discharge pipe 4 upstream of the compactor gate 8 and downstream of the face 6*a* of the compactor pusher 6. Simultaneously, the compactor gate 8 is lowered onto the refuse located therebeneath, pressing (clamping) it firmly, with its leading edge, against the floor of the discharge pipe 4. In this operational phase the device is in a position illustrated in FIG. 4.

Subsequently, a new refuse compacting operation takes place by advancing the compactor pusher 6 towards the partially lowered compactor gate 8, which, during the advance of the compactor pusher, is moved out of the passage, thus allowing an advance of the compressed refuse after the predetermined density of the new refuse batch has been reached. In this manner the refuse, in a continuous operation, is intermittently discharged through the discharge outlet 5 while prior to such discharge it forms a substantially vacuum tight plug by virtue of the initial cooperation between the compactor pusher 6 and the compactor gate 8.

It is thus seen that subsequent to the first formation of a substantially vacuum tight plug of refuse there is a coordination between the motions of the compactor pusher 6 and the compactor gate 8. The compactor gate 8 is lowered into its gating position as the compactor pusher 6 is moved rearward and is withdrawn to clear the discharge pipe 4 during the renewed forward motion of the compactor pusher 6 to permit the refuse plug to be built up and to be forwarded towards and through the discharge outlet 5 by the pushing action of the compactor pusher 6. The control of the motion of the two components 6 and 8 and their drive may be, for example, effected by a common hydraulic circuit containing both hydraulic power cylinders 7 and 9 and further having conventional solenoid valves that cause timed pressurization and depressurization of the power cylinders as controlled, for example, by a pressure gauge 7*a* coupled to the hydraulic power cylinder 7 of the compactor pusher 6. With such a gauge there is sensed the resistance and thus the density of the refuse undergoing compression. The control arrangement for the hydraulic drive may further include motion coordinating (i.e. timing) means such as limit switches 11*a* and 11*b* positioned at the withdrawn and advanced limit positions of the compactor pusher 6 for reversing the motion of the compactor pusher 6 and initiating the corresponding movements of the compactor gate 8. Thus, the limit switch 11*b* at the advanced limit position of the compactor pusher 6 also may initiate, when actuated by the compactor pusher 6, the lowering of the compactor gate 8. Since the hydraulic system and its control are, by themselves, conventional arrangements, they are not described in detail.

Figure 5:
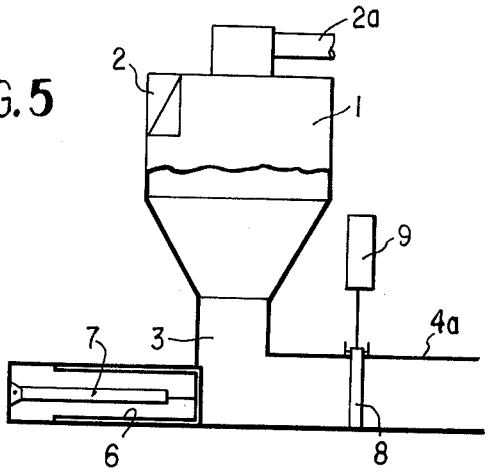
FIG. 5 is a schematic side elevational view incorporating a modification of the preferred embodiment.

Turning now to FIG. 5 there is shown a modification of the discharge device of FIG. 1. While in the latter, as explained above, the flow passage of the discharge pipe 4 is, along the portion between the hopper outlet 3 and the compactor gate 8, substantially of the same dimension as the frontal face 6*a* of the compactor pusher 6, in the FIG. 5 embodiment there is provided a clearance between the top side of the compactor pusher 6 and the adjacent wall of the discharge pipe 4*a*. This clearance may amount to approximately 4 inches for a 4 by 3 feet dimension of the frontal face 6*a* of the compactor pusher 6. The purpose of this clearance is to avoid overloading stresses due to jamming if, for example, the refuse contains a hard object.

Figure 6:
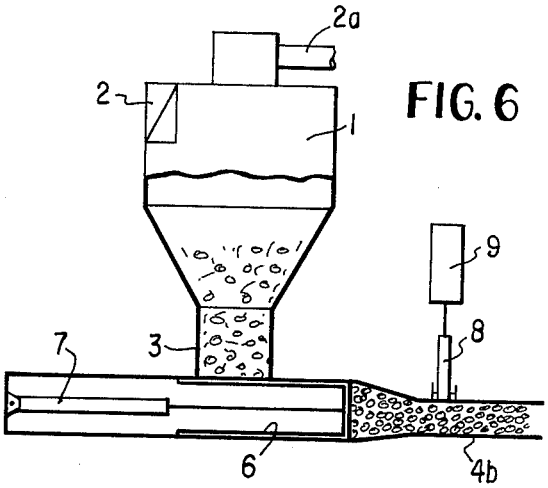
FIG. 6 is a schematic side elevational view incorporating another modification of the preferred embodiment.

Turning now to FIG. 6, there is shown a further modification of the discharge pipe between the hopper outlet 3 and the compactor gate 8. According to this modification, the discharge pipe 4*b* tapers towards the compactor gate 8 to generate an additional compressing effect on the refuse as it is forwarded by the compactor pusher 6. The advanced limit position of the face of the compactor pusher 6 is expediently at the start of the tapering portion as illustrated in FIG. 6.

Figure 7:
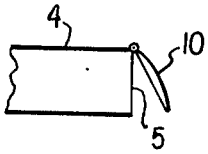
FIG. 7 is a schematic side elevational detail of the preferred embodiment incorporating an additional feature.

Turning now to FIG. 7, there is shown the terminal portion of the discharge pipe with its discharge outlet 5. The latter is controlled by a lid member 10 which is freely swingably attached to an upper portion of the discharge pipe. Normally, the lid member 10 assumes a vertical position and has sealing faces to be drawn against the discharge outlet 5 by the vacuum prevailing within the discharge pipe 4. During the discharging operation, the refuse forces the lid member 10 into an outwardly pivoted open position. The principal purpose of the lid member 10 is to aid the compactor gate 8 to maintain a vacuum tight seal in the initial phase of the discharge operation, i.e. when no vacuum tight refuse plug has yet been formed.

It will be understood that the above description of the present invention is susceptible to various modifications, changes and adaptations, and the same are intended to be comprehended within the meaning and range of equivalents of the appended claims.

What is claimed is:

1. A method of discharging refuse through a discharge pipe being in communication with a hopper having an outlet through which refuse is successively introduced into the discharge pipe from a vacuum transport system, comprising the following steps:

a. advancing a compactor gate into the discharge pipe in a direction perpendicular to the length dimension of the discharge pipe at a location between the hopper outlet and a discharge outlet of the discharge pipe for blocking the internal longitudinal passage thereof to substantially prevent air from being drawn into the vacuum transport system through the discharge outlet and the hopper;

b. subsequent to the completion of step (a) repeatedly reciprocating a compactor pusher in the discharge pipe from a withdrawn limit position in which communication between the hopper outlet and the discharge pipe is open, towards the lowered compactor gate to accumulate and compress successively introduced refuse between the compactor pusher and the compactor gate;

c. during performance of step (b), withdrawing the compactor gate to clear the discharge pipe passage when the refuse compressed between the compactor pusher and the compactor gate has reached a sufficient density to form a substantially vacuum tight plug;

d. during continued performance of step (b) and in timed coordination with the reciprocation of the compactor pusher, clamping a refuse portion firmly against the discharge pipe with an edge of the compactor gate while the reciprocating compactor pusher is being withdrawn into said withdrawn limit position and again withdrawing the compactor gate while the reciprocating compactor pusher is moving from the withdrawn limit position into the discharge pipe to forward the refuse continuously accumulated and compressed in step (b) towards and through the discharge outlet of the discharge pipe.

2. A method as defined in claim 1, further comprising the step of holding said compactor pusher stationary in said withdrawn limit position and holding the compactor gate stationary in its refuse clamping position of step (d) during an intermittent period of time and to resume operation by following up step (d).

3. A method as defined in claim 1, further comprising the step of sensing the resistance of the refuse undergoing compression in step (b) as a measure of its density.

* * * * *